US005184965A

United States Patent [19]

Myschik et al.

[11] Patent Number: 5,184,965

[45] Date of Patent: Feb. 9, 1993

[54] CONNECTOR FOR COAXIAL CABLES

[75] Inventors: Dieter Myschik, Hamburg; Paul Weidenhaupt, Gummersbach, both of Fed. Rep. of Germany

[73] Assignee: Minnesota Mining and Manufacturing Company, St. Paul, Minn.

[21] Appl. No.: 878,360

[22] Filed: May 4, 1992

[51] Int. Cl.[5] ..... H01R 13/00

[52] U.S. Cl. ..... 439/578; 439/607

[58] Field of Search ..... 439/578-585, 439/607-610

[56] References Cited

U.S. PATENT DOCUMENTS

| | | | |
|---|---|---|---|
| 3,587,028 | 6/1971 | Uberbacher | 339/14 |
| 3,848,164 | 11/1974 | Otte | 317/256 |
| 4,006,207 | 2/1977 | Yeshin | 264/108 |
| 4,088,385 | 5/1978 | Adkins | 339/143 |
| 4,340,265 | 7/1982 | Ott et al. | 339/14 R |
| 4,453,796 | 6/1984 | Monroe | 339/177 R |
| 4,519,665 | 5/1985 | Althouse et al. | 339/147 R |
| 4,556,275 | 12/1985 | Hamsher, Jr. | 339/218 M |
| 4,586,776 | 5/1986 | Ollis et al. | 339/105 |
| 4,762,508 | 8/1988 | Tengler et al. | 439/607 |
| 4,897,046 | 1/1990 | Tengler et al. | 439/579 |
| 4,906,207 | 3/1990 | Banning et al. | 439/578 |
| 4,923,412 | 5/1990 | Morris | 439/578 |
| 4,943,245 | 7/1990 | Lincoln | 439/578 |
| 4,964,814 | 10/1990 | Tengler et al. | 439/581 |
| 4,981,442 | 1/1991 | Shimizu et al. | 439/578 |
| 5,055,063 | 10/1991 | Sato | 439/607 |

FOREIGN PATENT DOCUMENTS

| | | |
|---|---|---|
| 0074205 | 8/1982 | European Pat. Off. . |
| 0131248 | 7/1984 | European Pat. Off. . |
| 0341535 | 4/1989 | European Pat. Off. . |
| 3732520A1 | 4/1989 | Fed. Rep. of Germany . |
| 3836141A1 | 4/1990 | Fed. Rep. of Germany . |

OTHER PUBLICATIONS

"The First Truly Controlled Impedance Transmission Line Assembly for High Density Applications," Jan. 1, 1988.

Fourteenth Annual Connectors and Interconnections Symposium Proceedings, "Interconnecting with Subminiature Digital Coax", Nov. 11 and 12, 1981.

*Primary Examiner*—Joseph H. McGlynn

*Attorney, Agent, or Firm*—Gary L. Griswold; Walter N. Kirn; John C. Barnes

[57] ABSTRACT

A connector for coaxial cables, in particular coaxial cables having a small diameter, comprising a tubular housing of electrically conductive material and having first and second opened ends, a signal contact mounted in said housing and connected to the conductor of said cable, said signal contact being electrically insulated relative to said housing, and a ground contact also mounted in said housing and electrically connected to the shield of said cable and/or to said housing, whereby an inner housing is provided compressed of two parts of insulating material which are adapted to be inserted into said tubular housing from at least one said open end thereof, with the outer dimensions of said inner housing corresponding to the inner dimensions of said tubular housing, and said inner housing having inner spaces to receive said signal and said ground contact in fixed relative spaced positions.

20 Claims, 5 Drawing Sheets

FIG.12
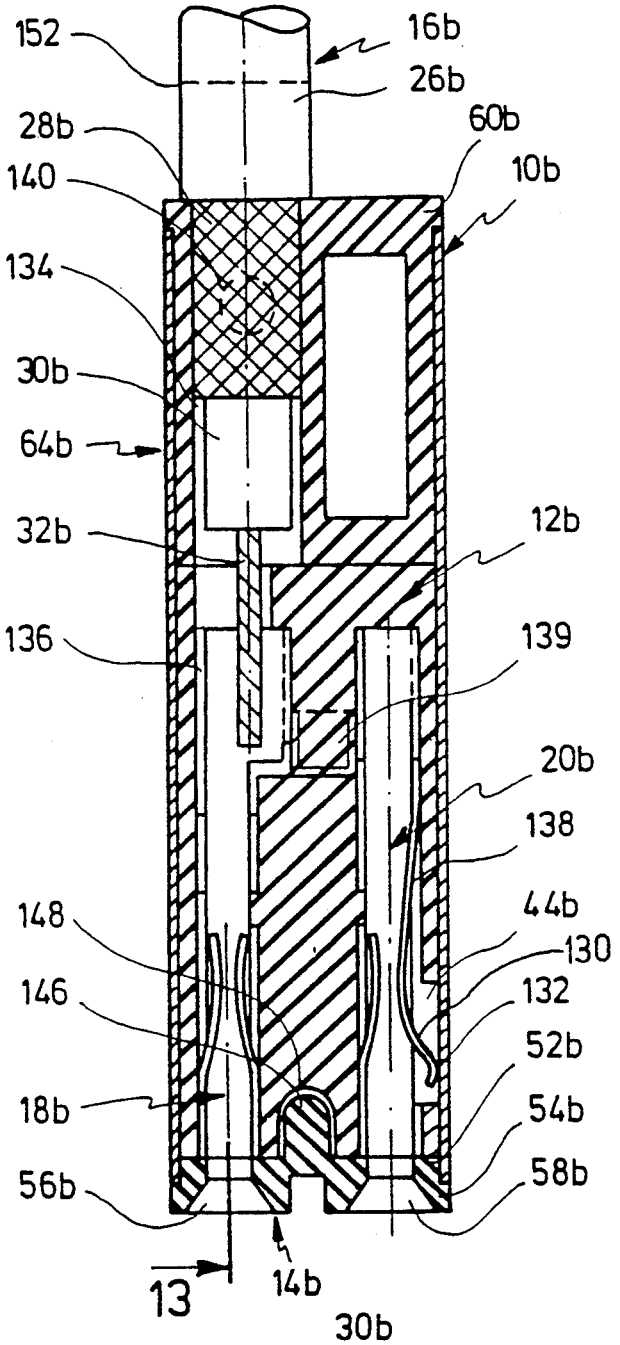
FIG.13
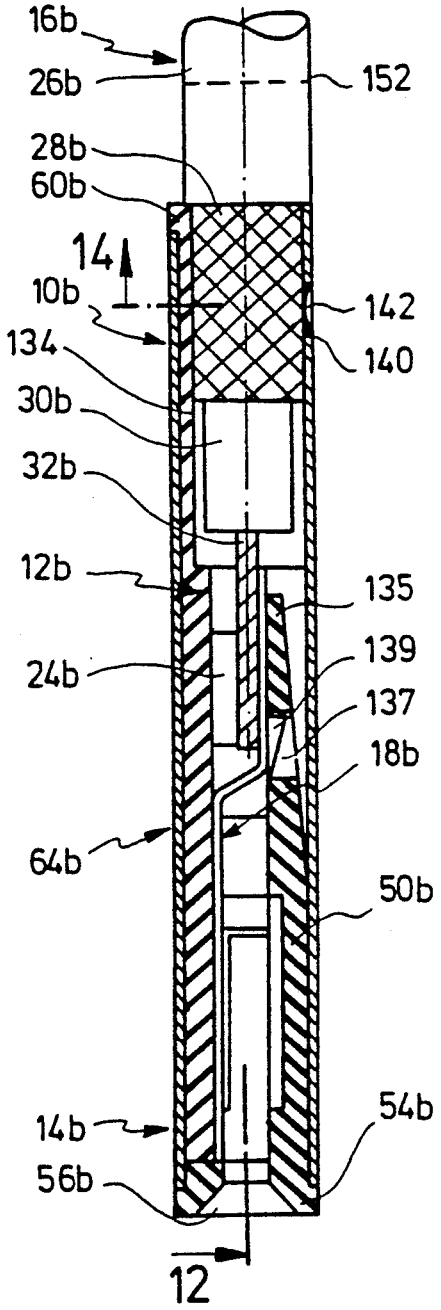
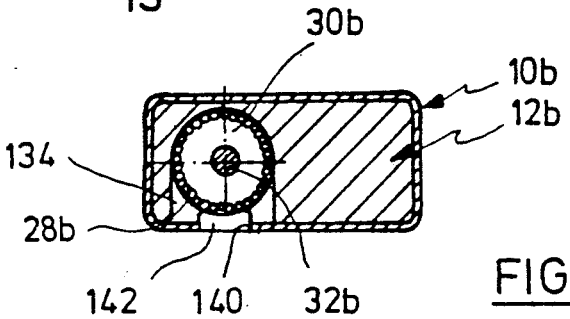
FIG.14

CONNECTOR FOR COAXIAL CABLES

The invention refers to a connector or coaxial cables, in particular coaxial cables having a small diameter.

PRIOR ART

Usually, connectors for coaxial cables are symmetrical with respect to the axis of rotation. In view of the shield effect they can be designed such that the resistance behavior is not remarkably different from the cable in the area of the connector. Examples of such connectors are disclosed by the German patent specification 37 32 520 or the US patent specifications 4 943 245, 4 006 207 or 4 923 412, respectively. Such connectors are less suited for a miniaturization in a modular form. Furthermore, the assembling of the coaxial cable end with such connectors includes at least partially manual steps.

However, modular connectors are known which allow a miniaturization. The U.S. patent specification 4 762 508 discloses a connector including a housing of insulating material. The housing receives a signal and a ground contact in parallel spaced arrangement. The coaxial cable is introduced into one end of the connector with the shield exposed and connected to the contacts. A plurality of such connectors is inserted into compartments of a multiple connector. The compartments are formed of insulating material while an enclosure accommodating the compartments is of metallic material for shielding purposes.

A prospectus "Controlled Impedance of 50 Ohms in Only 1/28 the Space" of "Chabin Transmission Line Applications," 3M Electronic Products Division of Jan. 1, 1988 discloses a connector for coaxial cables which has a box-like outer housing of electrically conductive material. The housing has an extrusion profile with a throughwall extending along the longitudinal axis of the housing and dividing the outer housing in two compartments. The compartment receiving the ground contact has a specific cross-sectional profile which is adapted to the cross-section of the ground contact. A sleeve-like insulating part is inserted into the other compartment from the front end and receives the signal contact inserted from the rear end thereof. The rear end of the signal contact is coupled to an insulating part and soldered to the conductor of the coaxial cable. Prior to this step, a conductive sleeve is pushed onto the prepared end of the coaxial cable and engages the exposed shield of the cable to accomplish an electrical connection. The thus prepared unit consisting of coaxial cable, sleeve and signal contact is subsequently plugged into the associated compartment of the housing from the rear. The sleeve electrically engages the housing so that a ground connection is established between the shield and the ground contact through the housing.

The last described connector also effects the desired shielded impedance in the connection area. However, the manufacture is relatively expensive as takes place at least partially manually.

SUMMARY OF THE INVENTION

The invention provides for a connector for coaxial cables, particularly for coaxial cables having a small diameter. The connector is suited to be manufactured completely by an automated process.

In the connector according to the invention, an inner housing is located within the conductive elongated tubular metal housing covering the inner housing, with the inner housing consisting of two parts adapted to be plugged into the tubular housing from at least one end thereof, which can be the outer housing. After assembly, the inner housing has a cross-sectional outer profile which corresponds substantially to the inner dimensions of the outer housing, preferably to the inner cross section of the inner space thereof The inner housing has spaces or the like which receive the signal and the ground contact in fixed relative position. A passage portion is formed for the receipt of the cable shield. The passage portion can be constituted by two approximately semi-circular recesses in both parts of the inner housing. Alternatively, it can be formed by a recess in one housing part having a bottom which for example is semi-circular. By a roughening or other irregular surface shapes, the shield can be safely retained by this portion of the inner housing.

During assembly, the contacts first can be placed in the corresponding housing part of the inner housing with the signal contact electrically connected to the conductor of the coaxial cable previously, e.g. by soldering or welding. Thereafter, the respective housing part is inserted into the outer housing. As to this, the second housing part can be already assembled with the first housing part. This is the case with an embodiment of the invention, wherein both housing parts of the inner housing are interlinked by a film hinge, with the axis of the hinge extending parallel to the longitudinal axis of the inner housing. In an alternative embodiment of the invention, each part of the inner housing is inserted from an opposite end into the outer housing, with one part already assembled with the cable and both contacts, before being inserted into the outer housing from the rear end thereof. In the latter case, the inner housing is only completed if both housing parts are inserted into the outer housing.

Irrespective of the specific structure of the inner housing, it can be stated that all manufacturing steps in order to assemble the connector and to attach it to a coaxial cable can be carried out automatically. Manual handling is not required.

In one embodiment of the invention, it is of advantage if the housing parts, inserted one part from opposite ends into the outer housing, are interlocked by a snapping connection. In this regard, an embodiment of the invention provides that the housing part inserted from the front end of the outer housing includes a flat portion having a recess or a projection while the other housing part has a projection or a recess. During assembly of both housing parts, the nose snaps into the recess so that both housing parts are safely received by the outer housing. At least one locking portion is resilient. According to a further embodiment of invention, the free end of the flat portion is spaced from the wall. If the other housing part is inserted, the flat portion is temporarily deformed towards the outer housing wall in order to allow an engagement of the projection with the recess.

According to a further embodiment of the invention, a flat connection portion at the rear end of the signal contact allows a simple automated attachment to a conductor of the coaxial cable which rests on the flat connection portion and is soldered thereon. Both, the signal and the ground contact are preferably bent of sheet material. The ground contact may be provided with a bent lateral extension at the rear end which engages the exposed shield. In order to establish an electrical connection with the conductive outer housing, an embodiment of the invention provides that the ground contact has at least a lateral resilient projection or ear which engages the inner wall surface of the outer housing. It is particularly advantageous if the ground contact has at least a resilient wiper contact portion, with a portion thereof engaging the inner wall of the outer housing and deformed laterally and pressed against the inner wall of the outer housing upon insertion of a contact pin. In this embodiment, the electrical contact of the ground contact with the outer housing is enhanced if a contact pin is inserted.

Alternatively, an electrical connection between the ground contact and the outer housing can be established in that the inner housing has an opening in the area of the cable shield and the outer housing has a hole in the area of the opening of the inner housing so that the shield can be soldered to the outer housing, preferably by microflame soldering.

This provides a simple and effective electrical connection with the outer housing and contemporarily a mechanical fixation.

In the connector according to the invention, it is not necessary to axially insert the cable with the exposed shield into a housing or a sleeve. This normally would require a manual handling which may damage the structure of the shield. In order to simply maintain the geometry of the shield also during assembly, an embodiment of the invention provides that the exposed shield of the cable is impregnated with solder material. This for example can be carried out by dipping an unprepared cable end into a solder bath a predetermined depth and for a predetermined time. Due to the capillary effect, the solder material penetrates into the interstices or meshes of the shield, with the outer jacket constituting a mold limiting the extension of the solder material laterally. By this, a very stable shield portion is achieved preventing the structure of the shield from suffering a change during assembly.

According to a further embodiment of the invention, the solder material extends below the outer jacket of the cable a predetermined length. The shield portion outside the connector still impregnated is thus stiffened and constitutes a resistance against a bending of the coaxial cable relative to the connector. Such a bending may affect the transmission properties of the coaxial cable.

BRIEF DESCRIPTION OF THE DRAWINGS

The invention is explained in more detail with reference to the accompanying drawings.

FIG. 12 is a longitudinal section through the connector of FIG. 11 along line 12—12 of FIG. 13.

FIG. 13 is a section through FIG. 12 along line 13—13.

FIG. 14 is a section through FIG. 13 along line 14—14.

DETAILED DESCRIPTION OF THE INVENTION

Figure 1:
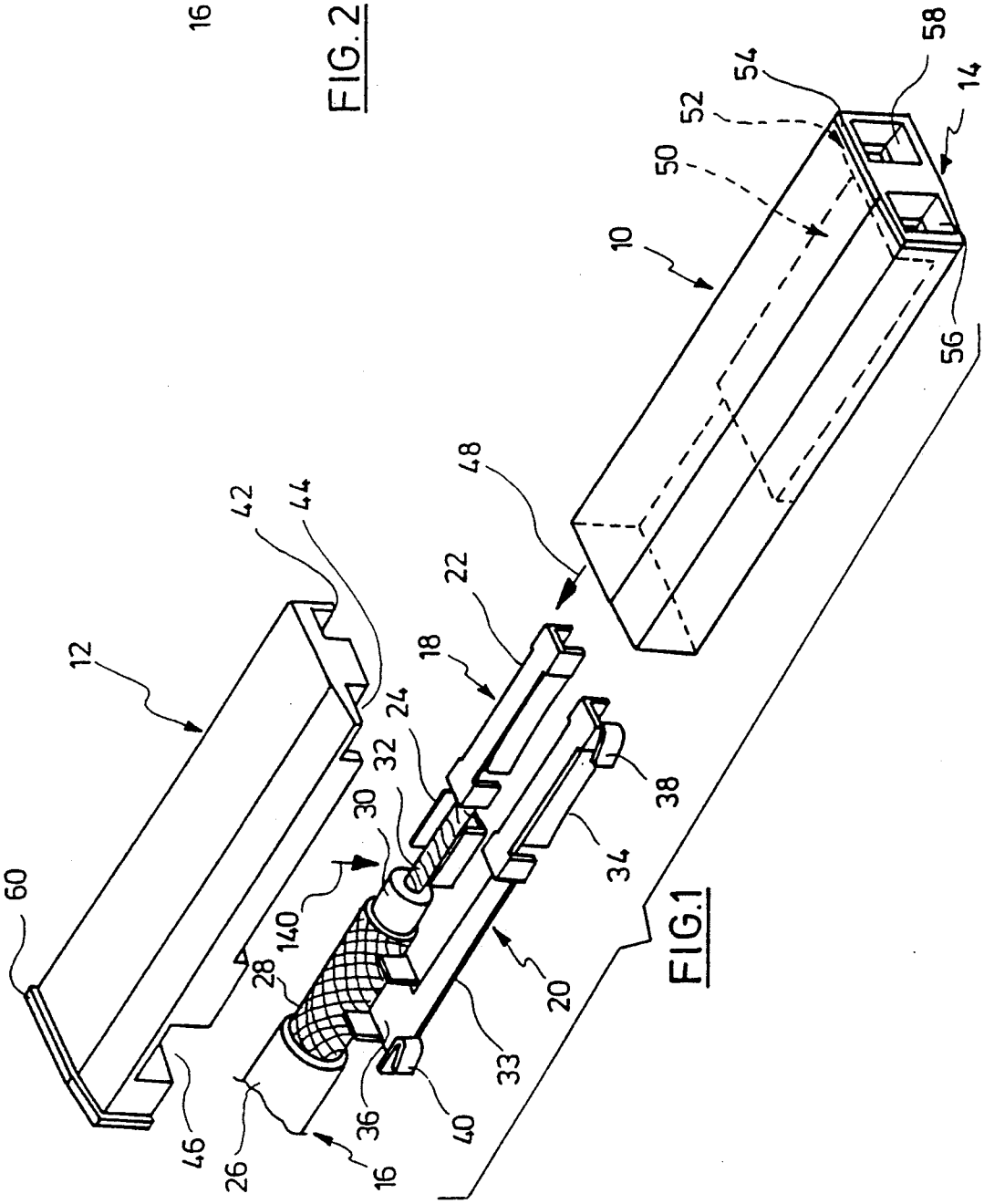
FIG. 1 is an exploded view of a first embodiment of a connector according to the invention.

In FIG. 1, an elongated tubular housing 10 of electrically conductive material can be seen which is open at opposite ends. In FIG. 1, also a housing part 12 of insulating material can be seen which constitutes an insulating inner housing in conjunction with a further housing part 14 already inserted into the tubular housing from the front end thereof. The tubular housing 10 is generally rectangular in cross section and can be the outer housing. A coaxial cable 16 is prepared at one end for the connection with a signal contact 18 and a ground contact 20.

The contacts 18, 20 are bend of sheet material in a suitable manner. Signal contact 18 includes a front passage-shaped plug-in portion 22, U-shaped in cross section and a rear connection portion 24, U-shaped in cross section and reversed from the U-portion 22. It appears not necessary to describe portion 22 in more detail since the structure and function thereof are already known.

As known, the coaxial cable has an outer jacket 26, a shield 28, a dielectric layer 30 and a central conductor 32. As shown, conductor 32 rests on the bottom of the web portion of the connection portion 24 and is attached thereto by soldering or welding. The preparation of the cable end is such that shield 28 is terminated at a distance from signal contact 18, with a portion of the dielectric layer 30 therebetween. The ground contact 20 includes a front plug-in portion 34 which is similarly structured as portion 22. It includes further a rear connection portion 33 which extends up to shield 28. A U-shaped portion 36 is formed at the end of portion 33 which engages shield 28. A flange (not shown) may be joined to the U-shaped portion 36 and engage the lower side of shield 28. A resilient ear 38 is bent outwardly, and a corresponding resilient ear 40 is bent outwardly at the front and rear end of contact 20, respectively.

The preparation of cable 16 and its attachment to the signal contact 18 can be carried out by an automated process (not shown). The ground contact 20 can be soldered to shield 28. It also can engage shield 28 as described with respect to in FIG. 1. Under circumstances, a soldering can be omitted.

The lower side of the housing part 12 in FIG. 1 is non-visible. It includes recesses for the receipt of the contacts 18, 20 and the cable portion including shield 28 in fixedly parallel positions. The recesses are indicated at 42, 44 and 46, respectively. By lowering the housing part 12 onto the arrangement of cable and contacts 18, 20 (see arrow 140), the parts are held in place. Subsequently, the outer housing 20 can be pushed onto this arrangement as indicated by arrow 48.

Prior to this step, housing part 14 is already assembled with outer housing 10. The housing part 14 consists also of insulating material and includes a flat portion 50 resting on the bottom of the outer housing 10 and having an end portion 52. A first portion of the end portion 52 has a cross section which corresponds to the cross section 54 of the inner space of outer housing 10. A second portion has a cross-sectional profile which corresponds to the outer contour of outer housing 10. Therefore, the second portion in the form of flange 54 engages the front end of the outer housing 10. End portion 52 has two rectangular plug-in openings 56, 58 which taper inwardly into housing 10. The flat portion 50 has a width which corresponds to the width of the inner space of housing 10.

If housing 10 and housing part 14 are considered with housing part 12 as described above, the flat portion 50 covers the housing part 12 from below only partially. The inner housing formed by housing parts 12, 14 has an outer contour such that it is fixedly received by the outer housing 10. The housing part 12 has a flange 60 extending beyond the outer contour of the outer housing and engages the rear end thereof as can be seen in FIG. 2 showing the assembled connector 64.

During assembly, the ears 38, 40 engage the associated inner wall of the outer housing 10 through the recesses 44, 46 of housing part 12. This establishes an electrical contact between ground contact and housing 10.

As can be seen, the described assembling of the individual components and of the complete connector can be carried out completely automatically in successive steps by means of suitable mounting devices. A manual handling is not necessary.

Figure 2:
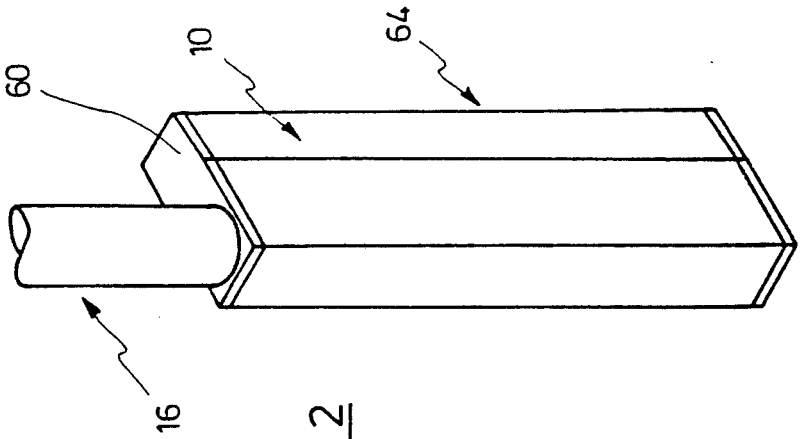
FIG. 2 is a perspective view of the assembled connector of FIG. 1.
Figure 4:
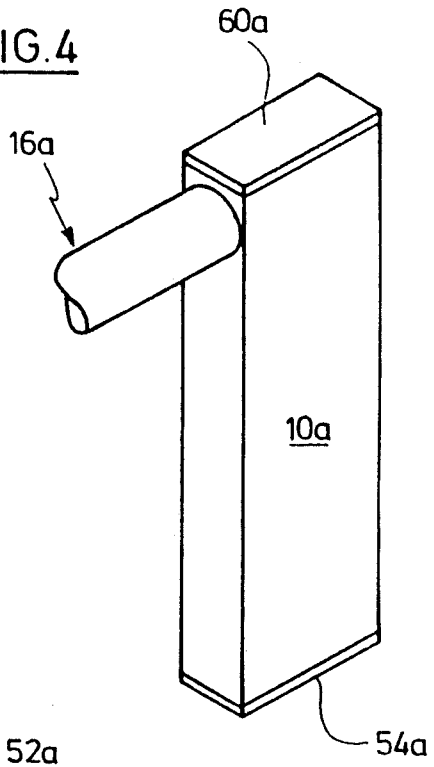
FIG. 4 is a perspective view of the assembled connector of FIG. 3.
Figure 3:
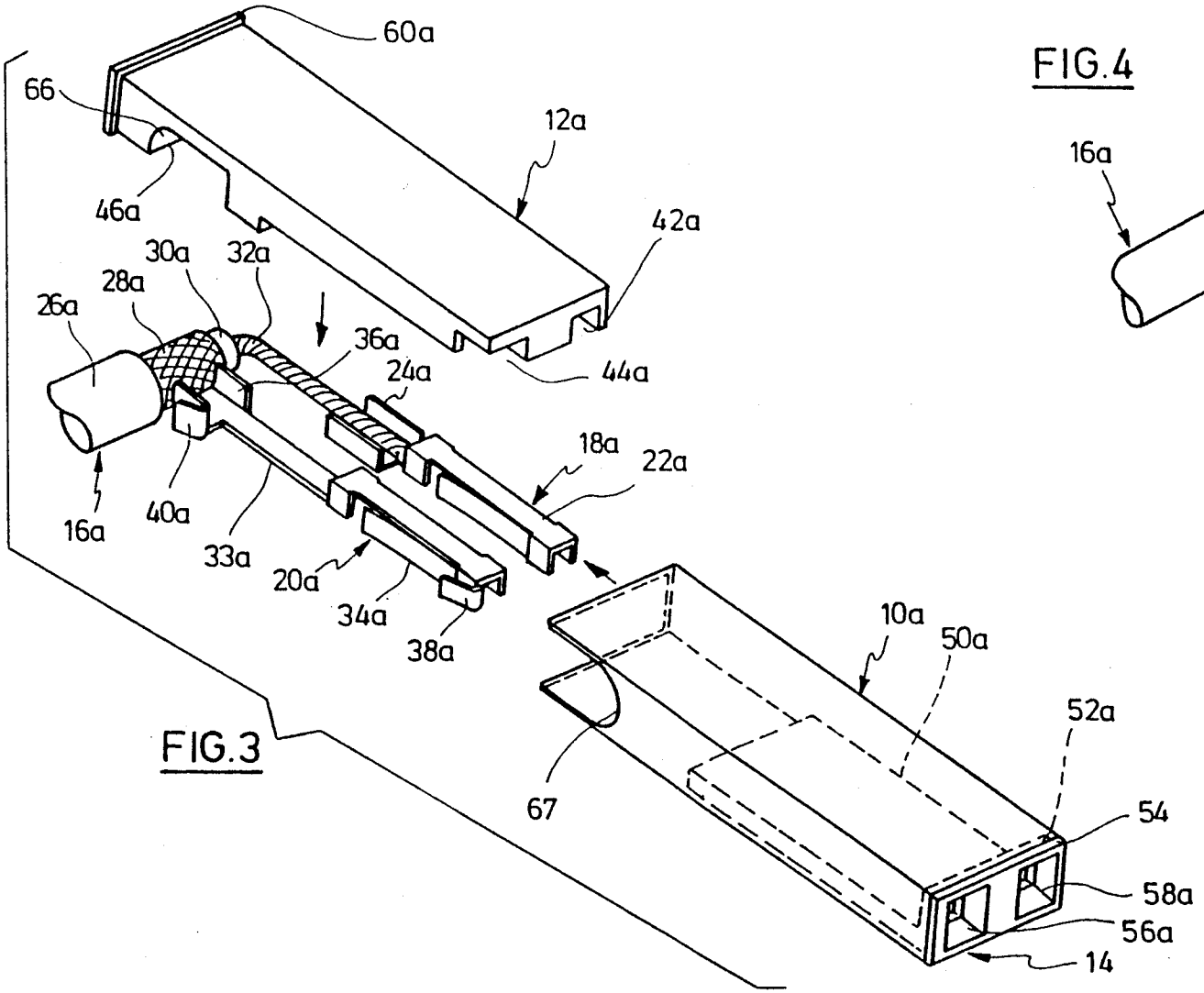
FIG. 3 is an exploded view of a further embodiment of a connector according to the invention.

The embodiment of the FIGS. 3 and 4 is very similar to the that of FIGS. 1 and 2. Therefore, the same or equivalent parts are provided with same reference numbers added by an "a". The difference from the embodiment of FIGS. 1 and 2 resides in the fact that the conductor 32*a* of the prepared cable 16*a* is angled about 90° with respect to the cable axis. The attachment to the signal contact 18*a* and the structure of the signal contact 18*a* correspond to the embodiment of FIGS. 1 and 2. Also the ground contact 20*a* is substantially equal to the ground contact 20 of FIG. 1. The U-shaped portion 36*a* extends axially up to the connection portion 33*a* in engagement with shield 28*a*. Therefore, an ear 40*a* is formed on one leg of the U-shaped portion 36*a*.

Since cable 16*a* is introduced into housing part 12 laterally, the recess 46*a* is somewhat larger than recess 46 of FIG. 1 and rounded at the bottom portion 66. A side wall of outer housing 10*a* has a recess 67*a* opened to one end of the housing, with the bottom of the recess also rounded for the engagement with the shield 28 after assembly. This can be carried out in the same manner as described in connection with FIGS. 1 and 2. In both cases, jacket 26, 26*a*, respectively, is to be removed such that its end terminates at or engages the outer housing 10, 10*a*, respectively.

Figures 5, 6, 7, 8, 9:
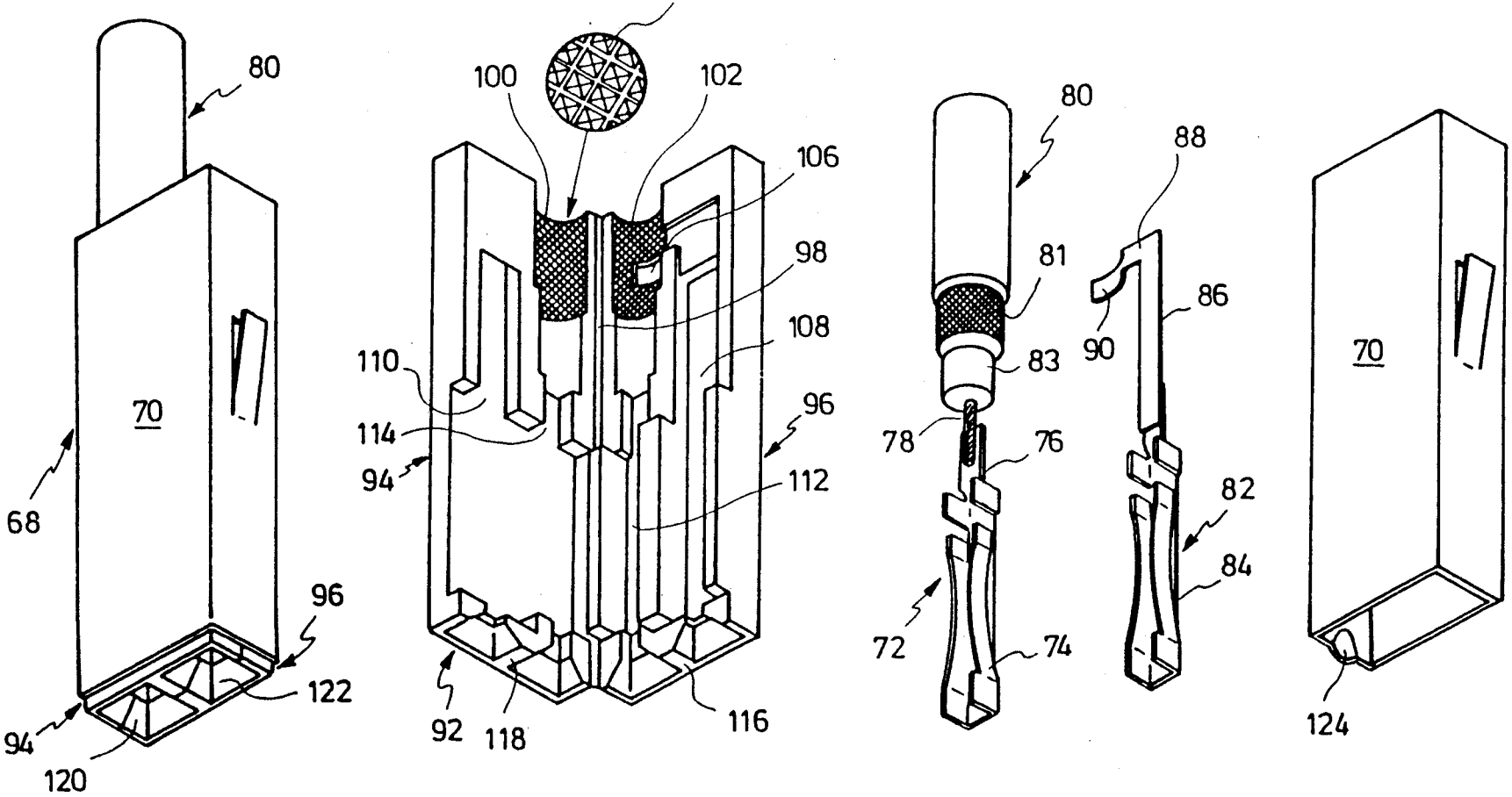
FIG. 5 is a perspective view of a third embodiment of an assembled connector according to the invention.
FIG. 6 is a perspective view of the inner housing of the connector of FIG. 5.
FIG. 7 is a perspective view of the connection of a coaxial cable with a signal contact for the connector of FIG. 5
FIG. 8 is a perspective view of the ground contact for the connector of FIG. 5.
FIG. 9 is a perspective view of the outer housing of the connector of FIG. 5.

The connector 68 of FIG. 5 consists of parts shown in the FIGS. 6 to 9. FIG. 9 is a perspective view of an elongated square outer housing 70 of metallic material. A signal contact 72 of FIG. 7 has a passage-shaped plug-in portion 74 and a rear connection portion 76 which is shaped as straight flange onto which the conductor 78 of a coaxial cable 80 is laid and attached thereto by welding or soldering. The coaxial cable 80 has an exposed shield portion 81 and an exposed dielectric layer 83. A ground contact 82 includes a plug-in portion 84 and a connection portion 86. The plug-in portion 84 is identical to that of signal contact 72 so that the expenditures for the manufacture of the contacts 72, 82 are minimal. The connection portion 86 is connected to the plug-in portion 84 through a flat strip, e.g. by welding or soldering. The connection portion 86 has a laterally extending flag 88 including a bent portion 90. The bent portion 90 is brought into engagement with shield 81 as will be described in more detail below.

FIG. 6 shows an inner housing 92. It consists of housing parts 94, 96 interlinked through a film hinge 98 having an axis parallel to the longitudinal axis of the housing parts 94, 96. The housing parts 94, 96 have a plurality of recesses on their inner surface. Recesses 100, 102 semicircular in cross section are formed at the rear end which constitute a cylindrical passage if the housing parts 94, 96 are folded together. The recesses 100, 102 are knurled as indicated at 104 in a larger scale. Recess 102 has a window 106. An elongated recess 108 of housing part 96 which cooperates with a recess 110 of housing part 94 serves for a fixed receipt of ground contact 82. If the ground contact 82 is mounted in recess 108, the portion 90 extends into the window 106.

An elongated recess 112 of housing part 96 cooperates with a recess 114 of housing part 94 for the fixed receipt of signal contact 72. The mentioned recesses are closed by end walls 116, 118 at the front end of the housing parts 94, 96 and engaged by the front ends of contacts 72, 82. The end walls 116, 118 have breakthroughs which constitute plug-in openings 120, 122 if the housing parts 94, 96 are folded together (FIG. 5). It is understood that the plug-in openings 120, 122 are aligned with the plug-in passages of the contacts 72, 82 as is also the case with the embodiments of the FIGS. 1 to 4.

As already mentioned, during assembly of the parts shown in the FIGS. 6 to 9, first the conductor 78 is connected to a signal contact 72. Thereafter, this unit is placed into the housing part 96, with the shield portion 82 engaging the recess 102 and signal contact 72 engaging recess 112. Previously, ground contact 82 is placed into recess 108. Subsequently, the housing parts 94, 96 are folded together. The portion 90 of flag 88 can be attached to the shield 81 106 by a suitable soldering or welding. Contemporarily, portion 90 establishes an electrical connection through the window with the outer housing 70.

As can be seen, the described mounting steps can be also automated and carried out by suitable assembly tools and devices (not shown).

It is still to be mentioned that the outer dimensions of the housing 92 correspond to the inner dimensions of housing 70 so that the inner housing 92 is firmly positioned within the outer housing 70.

At the front end, a side wall of the outer housing 70 has an impression 124. It defines an orientation aid for the connector 68 whereby the connector 68 cannot be plugged onto corresponding contact pins in a false attitude.

The embodiment of FIGS. 10 to 14 is relatively similar to that of FIGS. 1 and 2 so that equal or similar parts are provided with the same reference numbers added by a "b".

The signal contact 18*b* differs from signal contact 18 by a connection portion 24*b* having an L-shaped portion. The attachment of the connector 32*b* takes place in the manner described above. The shape of the ground contact 20*b* is approximately similar to that of signal contact 18*b* with the exception that a lateral wiper contact portion 130 has a subportion 132 bent outwardly. Similar to the embodiments of the FIGS. 1 to 4, the contacts 18*b* and 20*b* and the end of the coaxial cable 16*b* as well are accommodated by the housing part 12*b*. This can be seen in FIGS. 12 to 14. At the rear end, the housing part 12*b* has a passage-like recess 134 having a rounded bottom and adapted to receive the shield portion 18*b* of cable 16*b*. The contacts 18*b*, 20*b* are accommodated by corresponding recesses 136, 138 of housing part 12*b* and restrained therein. Suitable stop portions associated with the rear end of contact 18*b*, 20*b* limit a rearward movement. End portions 52*b*, 54*b* limit the movement of the contacts 18*b*, 20*b* towards the front end.

The flat portion 50*b* of the second housing part 14*b* is different from portion 50 of FIG. 1. It has upwardly facing recesses adjacent to the front end portion 52*b*. These recesses allow the portion 50*b* to be designed with a defined thickness. This is necessary to provide portion 50*b* with a taper as shown at 135 in FIG. 13. Portion 135 has a distance from the inner wall of the outer housing 10*b*. The portion 135 has a rectangular hole 137. It cooperates with a ramp-shaped nose 139 on the associated surface of the housing part 12*b* (FIG. 13).

Figure 10:
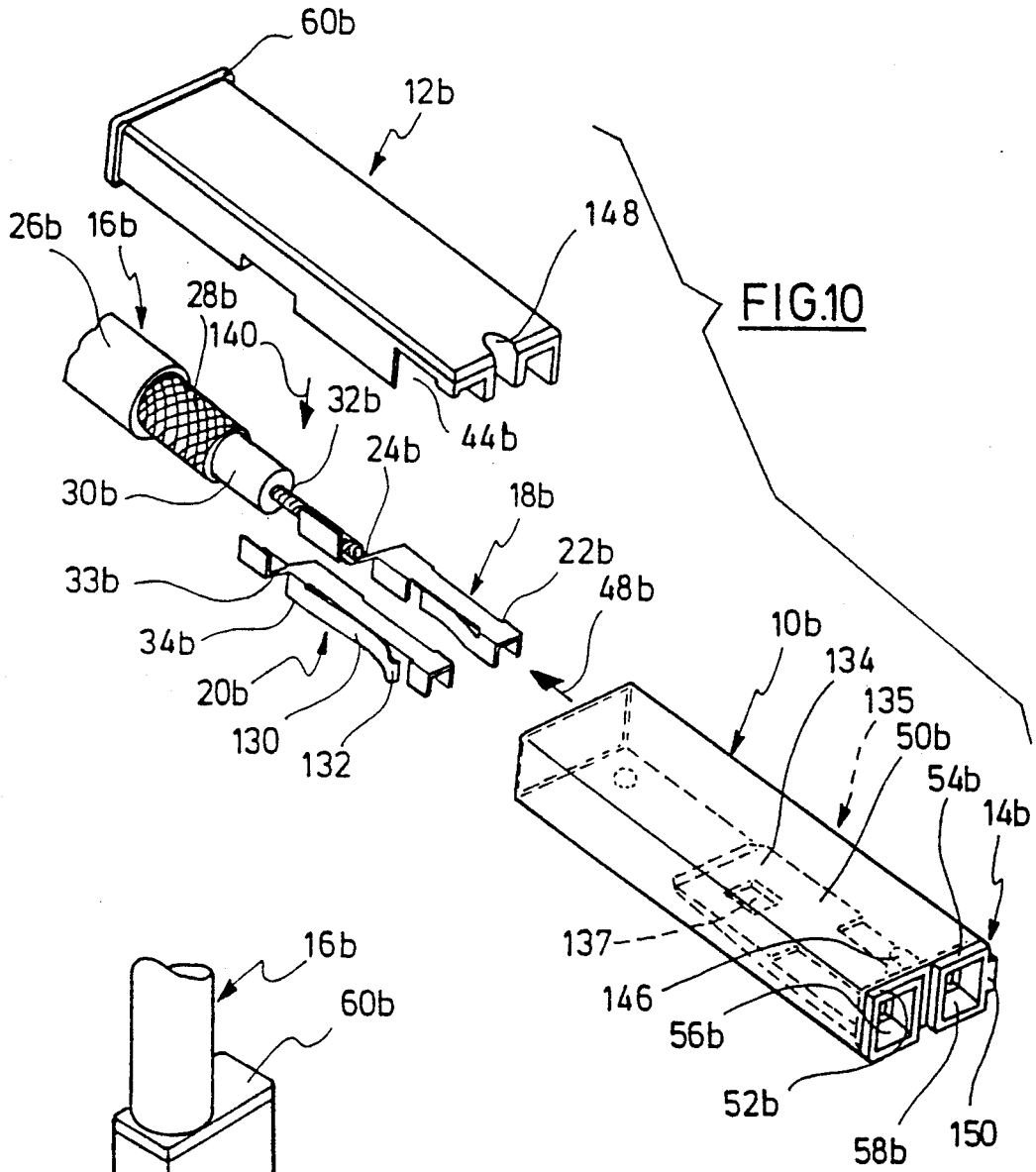
FIG. 10 is an exploded view of a fourth embodiment of a connector according to the invention.
Figure 11:
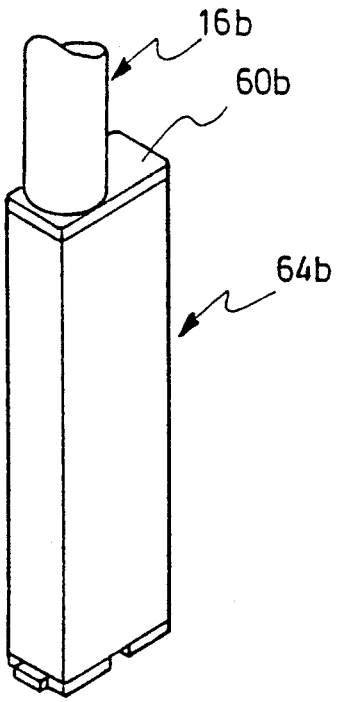
FIG. 11 is a perspective view of an assembled connector of FIG. 10.

During assembly, the contacts 18*b*, 20*b* are arranged as shown in FIG. 10, and contact 18*b* is attached to the conductor 32*b* of the coaxial cable 16*b*. Subsequently, the housing part 12*b* is positioned on the described arrangement from above along arrow 140, and this arrangement is firmly located in the housing part 12*b* as to be described in connection with the FIGS. 12 to 14. In a parallel processing step, the housing part 14 is plugged into the outer housing 10*b*. Thereafter, the outer housing 10*b* is pushed onto the housing part 12*b*. During this step, the ramp-shaped nose 139 travels along the associated surface of the portion 135 until it engages hole 137. By this, the housing parts 12*b* 14*b* are interlocked and safely located within the outer housing 10*b*. The outer dimensions of the housing parts 12*b* and 14*b* are such that they are adapted to the inner contour of the outer housing 10*b* in order to be stationarily position the inner housing in the outer housing.

As can be seen in FIG. 12, the ground contact 20*b* has a resilient wiper contact portion 130 which is formed as a leaf spring extending towards the front end of the connector. The wiper contact portion 130 has a subportion 138 bent into the interior of the ground contact 20*b*. It has further an outwardly bent subportion 132. As can be seen, subportion 132 extends through a recess 44*b* of the housing part 12*b* into engagement with the inner wall of the outer housing 10*b*. By this, an electrical connection is established with the outer housing 10*b* which is enhanced if a contact pin is inserted into the passage of the ground contact 20 through opening 58*b*. By this measure, the ground contact is electrically connected to the front portion of the conductive outer housing 10*b*.

As can be further seen in FIGS. 12 to 14, the outer housing 10*b* has a hole 140 in the area of the exposed shield portion 28*b*. The hole 140 is aligned with the passage-like recess 134 of the housing part 12*b*. Therefore, an electrical connection can be established between the shield 28*b* and the outer housing 10*b* by soldering material 142. The soldering process preferably takes place by means of a microflame soldering.

It is still to be mentioned that the housing part 14*b* has a nose-like projection 146 (see FIGS. 10 and 12) at the inner side which co-operates with the correspondingly formed recess 148 of the housing part 12*b* in order to effect a centering of the housing part 12*b* in the outer housing 10*b* and an alignment of the passages of the contacts 18*b*, 20*b* with the corresponding plug-in openings 56*b*, 58*b*.

As can be seen in FIG. 10, portion 54*b* of housing part 14*b* has a lateral projection 150 extending beyond the outer contour of the outer housing 10*b*. Similar to the impression 124 of FIG. 9, this projection serves for the orientation of the connector 64*b* if plugged onto corresponding contact pins.

In all embodiments of the FIGS. 1 to 14, the shield 28, 28*a*, 28*b*, 82 can be impregnated with solder material (not shown). This may take place for example by dipping the unprepared cable end into a solder bath. The jacket 26, 26*a*, 26*b* softens slightly by the heat and allows a penetration of solder material into the shield 28, 28*a*, 28*b* from the trimmed end due to the capillary effect. The individual filaments or wires of the shield, thus, are interconnected. Finally, the cable can be prepared in a known manner. It can be of advantage if the portion of the shield 28, 28*a*, 28*b* impregnated with solder material extends under the jacket 26, 26*a*, 26*b* as indicated at 152 in FIGS. 12 and 13. The impregnation of the shield with solder material strengthens the shield and serves for the maintenance of its geometrical structure. The reinforced shield portion extending beyond the connector prevents the coaxial cable 26*b* from being considerably bent near the connector.

We claim:

1. A connector for coaxial cables, in particular coaxial cable having a small diameter, and a conductor and shield, said connector comprising a tubular housing of electrically conductive material having inner walls defining an opening and first and second opposed open ends, a signal contact mounted in said housing and connected to the conductor of said cable, said signal contact being electrically insulated relative to said housing, and a ground contact also mounted in said housing, characterized in that an inner housing is provided comprised of two parts of insulating material which are adapted to be inserted into said tubular housing from at least one said open end thereof, with the outer dimensions of said inner housing corresponding to the inner dimensions of said tubular housing, and said inner housing having inner spaces to receive said signal contact and said ground contact in fixed relative spaced positions.

2. The connector of claim 1, wherein said inner housing has a passage portion for the receipt of a portion of said shield.

3. The connector of claim 1, wherein the wall of said passage portion has an irregular surface or the like.

4. The connector of claim 1, wherein said parts of said inner housing are linked together through a film hinge, with the axis of said hinge extending parallel to the longitudinal axis of said inner housing.

5. The connector of claim 1, wherein said signal contact includes a flat connection portion for the attachment of said conductor by soldering.

6. The connector of claim 1, wherein said ground contact has a lateral bent extension at one end thereof adapted to engage the exposed shield of said cable.

7. The connector of claim 1, wherein said inner housing has an opening in the area of said shield of said cable and said tubular housing has a hole in the area of said opening with said tubular housing being adapted to be soldered to said shield through said hole and opening.

8. The connector of claim 1, wherein at least one of said inner housing parts has stop means at one end thereof adapted to engage a said end of said tubular housing.

9. The connector of claim 1, wherein said housing parts of said inner housing are formed to be inserted into said tubular housing from opposite ends, with one of said housing parts supporting said cable and both contacts prior to its insertion into said tubular housing from one end thereof.

10. The connector of claim 9, wherein said tubular housing part inserted from said second end of said tubular housing is formed with two separated openings aligned with said respective contacts.

11. The connector of claim 9 wherein said inner housing parts are interlocked by a snapping connection.

12. The connector of claim 11, wherein said housing part inserted from said second end of said tubular housing includes a flat portion engaging a wall of said outer housing, with said flat portion and the other said housing part having a cooperating projection and a recess to lock the parts of said inner housing together.

13. The connector of claim 1, wherein said ground contact has at least one lateral resilient contact portion for engagement with the inner wall of said tubular housing.

14. The connector of claim 13, wherein both the front and the rear end of said ground contact are provided with a said resilient portion.

15. The connector of claim 1, wherein said ground contact has at least one wiper contact portion having at least one portion adapted to engage said inner wall of said tubular housing, with said wiper portion being deformed laterally and pressed against said inner wall upon insertion of a contact pin into said ground contact.

16. The connector of claim 15, wherein the free end of said wiper contact portion engages said inner wall.

17. The connector of claim 1, wherein an exposed portion of said shield of said cable is impregnated with solder material.

18. The connector of claim 17, wherein the portion of said shield impregnated with solder material extends under the outer jacket of said cable a predetermined length.

19. A connector for coaxial cables, particularly for small diameter cables, comprising an elongated hollow tubular housing of electrically conductive material, a signal contact member insulatedly located within said housing, and a ground contact member mounted in said housing, said ground contact member having a resilient contact portion which engages said housing and is pressed against said housing if a contact pin or the like is inserted into said ground contact member.

20. The connector of claim 19, wherein said ground contact member and said signal contact member are located within an inner housing of insulating material without clearance, with said inner housing being fittingly inserted into said tubular housing, and said inner housing having an opening allowing said resilient contact portion therethrough into engagement with said housing.

* * * * *